US010525706B2

(12) United States Patent
Shimazoe

(10) Patent No.: US 10,525,706 B2
(45) Date of Patent: Jan. 7, 2020

(54) INKJET RECORDING APPARATUS AND INKJET RECORDING METHOD

(71) Applicant: Konica Minolta, Inc., Chiyoda-ku, Tokyo (JP)

(72) Inventor: Masanori Shimazoe, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 25 days.

(21) Appl. No.: 15/743,106

(22) PCT Filed: Jul. 5, 2016

(86) PCT No.: PCT/JP2016/069910

§ 371 (c)(1),
(2) Date: Jan. 9, 2018

(87) PCT Pub. No.: WO2017/010353

PCT Pub. Date: Jan. 19, 2017

(65) Prior Publication Data

US 2019/0077146 A1 Mar. 14, 2019

(30) Foreign Application Priority Data

Jul. 10, 2015 (JP) ..... 2015-138856

(51) Int. Cl.
*B41J 2/045* (2006.01)
*B41J 2/21* (2006.01)

(52) U.S. Cl.
CPC ..... *B41J 2/04593* (2013.01); *B41J 2/0459* (2013.01); *B41J 2/04541* (2013.01);
(Continued)

(58) Field of Classification Search
CPC ..... B41J 2/04593; B41J 2/04588; B41J 2/04581; B41J 2/04541; B41J 2/0459; B41J 2/2128
(Continued)

(56) References Cited

U.S. PATENT DOCUMENTS 8,955,932 B2 * 2/2015 Yanaka ..... B41J 2/04588 347/10

FOREIGN PATENT DOCUMENTS

JP 09164702 A 6/1997
JP 2004042576 A 2/2004
(Continued)

OTHER PUBLICATIONS

Extended European Search Report corresponding to Application No. 16824333.5-1019/3321089 PCT/JP2016069910; dated Jun. 27, 2018.

(Continued)

*Primary Examiner* — An H Do
(74) *Attorney, Agent, or Firm* — Cantor Colburn LLP

(57) ABSTRACT

An inkjet recording apparatus and an inkjet recording method which enable changing a droplet amount without changing a droplet speed of an ink discharged from the same nozzle, and including an inkjet head which expands and contracts a capacity of a pressure chamber by applying a driving signal to an actuator and a driving circuit which applies the driving signal to the actuator, the driving signal including a first expansion pulse which starts from a reference potential and expands the capacity of the pressure chamber, a first contraction pulse which contracts the capacity of the pressure chamber to discharge the ink from the nozzle, a second expansion pulse which expands the capacity of the pressure chamber, and a second contraction pulse which contracts the capacity of the pressure chamber and returns to the reference potential in the mentioned order, the driving circuit being configured to enable discharging different droplet amounts of the ink from the same nozzle by changing a potential difference between a start edge and an end edge of the first contraction pulse.

24 Claims, 6 Drawing Sheets

(52) U.S. Cl.
CPC ..... *B41J 2/04581* (2013.01); *B41J 2/04588* (2013.01); *B41J 2/2128* (2013.01)

(58) Field of Classification Search
USPC ..... 347/9–11
See application file for complete search history.

(56) References Cited

FOREIGN PATENT DOCUMENTS

| | | | |
|---|---|---|---|
| JP | 2005212365 | A | 8/2005 |
| JP | 2007144931 | A | 6/2007 |
| JP | 2015006777 | A | 1/2015 |
| JP | 2015066852 | A | 4/2015 |
| WO | 2012121019 | A1 | 9/2012 |

OTHER PUBLICATIONS

International Preliminary Report on Patentability corresponding to Application No. PCT/JP2016/069910; dated Jan. 25, 2018.
International Search Report corresponding to Application No. PCT/JP2016/069910; dated Aug. 23, 2016.

* cited by examiner

INKJET RECORDING APPARATUS AND INKJET RECORDING METHOD

CROSS REFERENCE TO RELATED APPLICATIONS

This is the U.S. national stage of application No. PCT/JP2016/069910, filed on Jul. 5, 2016. Priority under 35 U.S.C. § 119(a) and 35 U.S.C. § 365(b) is claimed from Japanese Application No. 2015-138856, filed Jul. 10, 2015; the disclosure of which is incorporated herein by reference.

TECHNICAL FIELD

The present invention relates to an inkjet recording apparatus and an inkjet recording method, and more particularly to an inkjet recording apparatus and an inkjet recording method which can readily change a droplet amount without changing a droplet speed of an ink discharged from the same nozzle.

BACKGROUND ART

In recent years, in image formation using an inkjet head, high-definition image quality comparable to a photographic image has been demanded. Thus, a droplet amount of an ink discharged from nozzles of the inkjet head is rigorously supervised.

As a conventional example, Patent Document 1 discloses that viscosity of the ink varies due to a change in environmental temperature, a speed of an ink droplet or a volume of the ink droplet varies and, in a driving signal including a first waveform element which expands a capacity of a pressurizing chamber, a second waveform element which holds an expanded state, and a third waveform element which contracts the capacity of the pressurizing chamber to discharge ink droplets, a difference between a potential difference of the first waveform element and the second waveform element and a potential difference of the third waveform element and the second waveform difference is decreased when an environmental temperature is high or increased when the environmental temperature is low.

Patent Document 2 discloses that, when a temperature rises and viscosity of an ink decreases, an amplitude of a driving signal is changed to become small in accordance with a predetermined formula.

Patent Document 3 discloses that a plurality of nozzles of an inkjet head are divided into a plurality of groups each consisting of one or more nozzles, a driving voltage value of expansion pulses is set to become common to the respective groups, and a driving signal which has a driving voltage value of contraction pulses independently set in accordance with the magnitude of a droplet speed for each group is applied to the head, whereby a fluctuation in droplet amount due to a variation of the droplet speed of each nozzle is suppressed.

PRIOR ART DOCUMENTS

Patent Documents

Patent Document 1: JP-A-2004-42576

Patent Document 2: JP-A-2005-212365

Patent Document 3: JP-A1-2012-121019

SUMMARY

Problem to be Solved by the Invention

Meanwhile, in an inkjet recoding apparatus, different droplet amounts of an ink are discharged from the same nozzle of an inkjet head to express multi-gradation.

To discharge the different droplet amounts of the ink from the same nozzle, a method for selecting and applying a dedicated driving signal corresponding to each droplet amount is general. However, the plurality of driving signals must be prepared in correspondence with the different droplet amounts, and control is also complicated.

Further, when the driving signal is changed, there is fear that a droplet speed also varies. In this case, since an impact positional displacement occurs every time a different droplet amount of the ink is discharged, discharge timing must be also adjusted simultaneously with a change in droplet amount, and hence the control becomes very complicated. Thus, it is desirable to enable discharging the different droplet amounts of the ink from the same nozzle of the inkjet head without changing the droplet speed.

In Patent Literatures 1 and 2 described above, the driving signal is changed in correspondence with a change in viscosity of the ink and, in Patent Literature 3 described above, a fluctuation in droplet amount is suppressed among the plurality of nozzles of the inkjet head. Thus, in all the literatures, different droplet amounts of the ink are not discharged from the same nozzle of the inkjet head without changing the droplet speed.

Thus, it is an object of the present invention to provide an inkjet recording apparatus and an inkjet recording method which enable changing a droplet amount without changing a droplet speed of an ink discharged from the same nozzle.

Other objects of the present invention will become obvious from the following description.

Solution to Problem

1. An inkjet recording apparatus comprising:

an inkjet head which expands and contracts a capacity of a pressure chamber corresponding to an actuator by applying a driving signal to the actuator, and thus discharges an ink in the pressure chamber from a nozzle to perform printing on a recording medium; and a driving circuit which applies the driving signal to the actuator of the inkjet head, wherein the driving signal includes a first expansion pulse which starts from a reference potential and expands the capacity of the pressure chamber, a first contraction pulse which contracts the capacity of the pressure chamber to discharge the ink from the nozzle, a second expansion pulse which expands the capacity of the pressure chamber, and a contraction pulse which contracts the capacity of the pressure chamber and returns to the reference potential in the mentioned order, and the driving circuit is configured to discharge different droplet amounts of the ink from the same nozzle by changing a potential difference between a start edge and an end edge of the first contraction pulse.

2. The inkjet recording apparatus according to 1, wherein the driving circuit discharges the different droplet amounts of the ink from the same nozzle by changing the potential difference, and thus performs multi-gradation printing on the recording medium.

3. The inkjet recording apparatus according to 1 or 2, wherein the driving circuit is configured to enable changing the potential difference in correspondence with a type of the recording medium.

4. The inkjet recording apparatus according to 1, 2, or 3, wherein the driving circuit is configured to enable changing a potential difference $\Delta V2$ so that a potential difference ratio $\Delta V2/\Delta V1$ falls within a range of 0.8 to 1.2, where $\Delta V1$ is a potential difference between the reference potential and an end edge of the first expansion pulse and $\Delta V2$ is a potential difference between a start edge and an end edge of the first contraction pulse.

5. The inkjet recording apparatus according to any one of 1 to 4, wherein a period T1 from the start edge of the first expansion pulse to the start edge of the first contraction pulse is 0.45 Tc or more and 0.55 Tc or less, where Tc is a vibration cycle of the ink in the pressure chamber.

6. The inkjet recording apparatus according to any one of 1 to 5, wherein $\Delta V2>\Delta V3$ is achieved, where $\Delta V2$ is the potential difference between the start edge and the end edge of the first contraction pulse and $\Delta V3$ is a potential difference between the start edge of the second contraction pulse and the reference potential.

7. The inkjet recording apparatus according to 6, wherein a potential difference ratio $\Delta V3/\Delta V2$ is 0.3 or more and 0.9 or less.

8. The inkjet recording apparatus according to 6, wherein a potential difference ratio $\Delta V3/\Delta V2$ is 0.5 or more and 0.9 or less.

9. The inkjet recording apparatus according to any one of 1 to 8, wherein T2/T1 is 0.6 or more and 1.2 or less, where T1 is a period from the start edge of the first expansion pulse to the start edge of the first contraction pulse and T2 is a period from the start edge of the first contraction pulse and the start edge of the second expansion pulse.

10. The inkjet recording apparatus according to any one of 1 to 8, wherein T2/T1 is 0.6 or more and 1.0 or less, where T1 is a period from the start edge of the first expansion pulse to the start edge of the first contraction pulse and T2 is a period from the start edge of the first contraction pulse to the start edge of the second expansion pulse.

11. The inkjet recording apparatus according to any one of 1 to 10, wherein the driving signal has a slope waveform.

12. An inkjet recording method comprising expanding and contracting a capacity of a pressure chamber corresponding to an actuator by applying a driving signal to the actuator of an inkjet head, and thus discharging an ink in the pressure chamber from a nozzle to perform printing on a recording medium, wherein the driving signal includes a first expansion pulse which starts from a reference potential and expands the capacity of the pressure chamber, a first contraction pulse which contracts the capacity of the pressure chamber to discharge the ink from the nozzle, a second expansion pulse which expands the capacity of the pressure chamber, and a contraction pulse which contracts the capacity of the pressure chamber and returns to the reference potential in the mentioned order, and different droplet amounts of the ink are discharged from the same nozzle by changing a potential difference between a start edge and an end edge of the first contraction pulse.

13. The inkjet recording method according to 12, wherein the different droplet amounts of the ink are discharged from the same nozzle by changing the potential difference, and thus multi-gradation printing is performed on the recording medium.

14. The inkjet recording method according to 12 or 13, wherein the potential difference is changed in correspondence with a type of the recording medium.

15. The inkjet recording method according to 12, 13, or 14, wherein a potential difference $\Delta V2$ is changed so that a potential difference ratio $\Delta V2/\Delta V1$ falls within a range of 0.8 to 1.2, where $\Delta V1$ is a potential difference between the reference potential and an end edge of the first expansion pulse and $\Delta V2$ is a potential difference between a start edge and an end edge of the first contraction pulse.

16. The inkjet recording method according to any one of 12 to 15, wherein a period T1 from the start edge of the first expansion pulse to the start edge of the first contraction pulse is 0.45 Tc or more and 0.55 Tc or less, where Tc is a vibration cycle of the ink in the pressure chamber.

17. The inkjet recording method according to any one of 12 to 16, wherein $\Delta V2>\Delta V3$ is achieved, where $\Delta V2$ is the potential difference between the start edge of the first contraction pulse and the end edge of the first contraction pulse and $\Delta V3$ is a potential difference between the start edge of the second contraction pulse and the reference potential.

18. The inkjet recording method according to 17, wherein a potential difference ratio $\Delta V3/\Delta V2$ is 0.3 or more and 0.9 or less.

19. The inkjet recording method according to 17, wherein a potential difference ratio $\Delta V3/\Delta V2$ is 0.5 or more and 0.9 or less.

20. The inkjet recording method according to any one of 12 to 19, wherein T2/T1 is 0.6 or more and 1.2 or less, where T1 is a period from the start edge of the first expansion pulse to the start edge of the first contraction pulse and T2 is a period from the start edge of the first contraction pulse and the start edge of the second expansion pulse.

21. The inkjet recording method according to any one of 12 to 19, wherein T2/T1 is 0.6 or more and 1.0 or less, where T1 is a period from the start edge of the first expansion pulse to the start edge of the first contraction pulse and T2 is a period from the start edge of the first contraction pulse to the start edge of the second expansion pulse.

22. The inkjet recording method according to any one of 12 to 21, wherein the driving signal has a slope waveform.

Effect of the Invention

According to the present invention, it is possible to provide the inkjet recording apparatus and the inkjet recording method which enable changing a droplet amount without changing a droplet speed of an ink discharged from the same nozzle.

DETAILED DESCRIPTION OF EMBODIMENTS

An embodiment of the present invention will now be described hereinafter with reference to the drawings.

Figure 1:
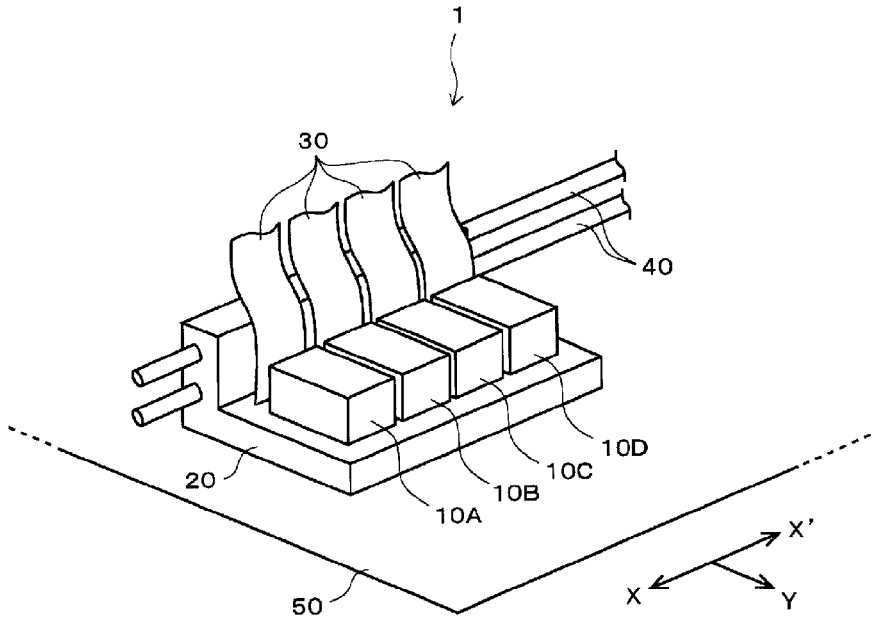
FIG. 1 is a schematic block diagram showing an embodiment of an inkjet recording apparatus according to the present invention.

FIG. 1 is a schematic block diagram showing an embodiment of an inkjet recording apparatus according to the present invention.

As shown in FIG. 1, the inkjet recording apparatus 1 includes a plurality of inkjet heads 10A to 10D. In this embodiment, the four inkjet heads 10A to 10D for respective ink colors of, e.g., Y (yellow), M (magenta), C (cyan), and K (black) are juxtaposed in an X-X' direction (a main scanning direction) in the drawing, but the number of inkjet heads is not restricted in particular in the present invention, and at least one inkjet can suffice.

The inkjet heads 10A to 10D are mounted on a common carriage 20 in such a manner that their nozzle surface sides face a recording medium 50, and electrically connected with a control apparatus (not shown in FIG. 1) provided in the inkjet recording apparatus 1 through flexible cables 30.

The carriage 20 can reciprocate in the main scanning direction along guide rails 40 by a main scanning motor (not shown in FIG. 1). Further, the recording medium 50 is intermittently carried by each predetermined amount along a Y direction in the drawing crossing the main scanning direction by driving of a sub-scanning motor (not shown in FIG. 1).

This inkjet recording apparatus 1 discharges inks from the respective inkjet heads 10A to 10D toward the recording medium 50 in a process of moving the respective inkjet heads 10A to 10D in the main scanning direction by movement of the carriage 20. Furthermore, printing (which will be also referred to as photographic printing hereinafter) of a predetermined image is performed on the recording medium 50 by cooperation of the movement of the inkjet heads 10A to 10D in the main scanning direction and the intermittent carriage of the recording medium 50 in a sub-scanning direction.

Next, an embodiment of the inkjet heads 10A to 10D will now be described with reference to a cross-sectional view of the inkjet head shown in FIG. 2. Since the respective inkjet heads 10A to 10D have the same configuration, a configuration of one inkjet head denoted by reference sign 10 will be described with reference to FIG. 2.

Figure 2:
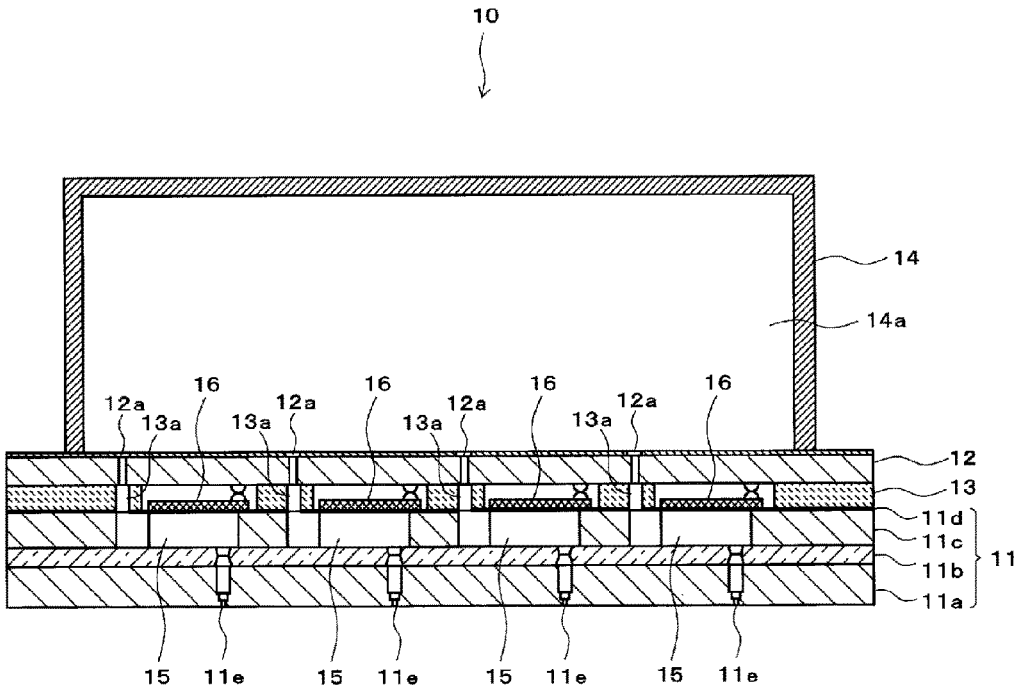
FIG. 2 is a cross-sectional view showing an embodiment of an inkjet head.

As shown in FIG. 2, the inkjet head 10 is constituted by laminating a head substrate 11, a wiring substrate 12, and an adhesive resin layer 13. An ink manifold 14 is joined to an upper surface of the wiring substrate 12. The inside of the ink manifold 14 is a common ink chamber 14*a* in which an ink is stored between the ink manifold 14 and the wiring substrate 12.

In the head substrate 11, a nozzle plate 11*a* formed of an Si (silicon) substrate, an intermediate plate 11*b* formed of a glass substrate, a pressure chamber plate 11*c* formed of an Si (silicon) substrate, and a vibration plate (diaphragm) 11*d* formed of an $SiO_2$ thin film are laminated from a lower layer side in FIG. 2. A plurality of nozzles 11*e* are opened in a lower surface of the nozzle plate 11*a*.

A plurality of pressure chambers 15 which store the ink respectively are formed in the pressure chamber plate 11*c*. An upper wall of each pressure chamber 15 is formed of the vibration plate 11*d*, and a lower wall of the same is constituted of the intermediate plate 11*b*. The respective pressure chambers 15 communicate with the nozzles 11*e* through the intermediate plate 11*b*, respectively.

Actuators 16 are laminated on an upper surface of the vibration plate 11*d* in correspondence with the respective pressure chambers 15 on one-on-one level. Each actuator 16 has a configuration that a piezoelectric element such as a thin film PZT is sandwiched between an upper electrode and a lower electrode (both of which are not shown) as driving electrodes. The upper electrode is arranged on an upper surface of an actuator main body, and the lower electrode is arranged on the lower surface of the piezoelectric element. The lower electrode extends on an upper surface of the vibration plate 11*d*, and constitutes a common electrode common to all the actuators 16. The lower electrode is earthed.

The wiring substrate 12 is a substrate which includes wiring lines configured to apply driving signals from driving circuits (not shown in FIG. 1 and FIG. 2) provided for the inkjet heads 10A to 10D respectively to the driving electrodes of the respective actuators 16.

The adhesive resin layer 13 is formed of, e.g., a thermosetting photosensitive adhesive resin sheet, and integrally bonds the head substrate 11 and the wiring substrate 12 between both the substrates 11 and 12. A gap corresponding to a thickness of this adhesive resin layer 13 is provided between both the substrates 11 and 12. Regions of the adhesive resin layer 13 corresponding to the actuators 16 and their peripheries are removed by exposure and development. Each actuator 16 is arranged in a space where this adhesive resin layer 13 is removed.

Vertically piercing through holes 13*a* are formed in the adhesive resin layer 13 in correspondence with the pressure chambers 15, respectively. One end (an upper end) of each through hole 13*a* communicates with an ink supply path 12*a* formed in the wiring substrate 12, and the other end (a lower end) of the same communicates with the inside of the pressure chamber 15. The ink supply path 12*a* is opened in the common ink chamber 14*a*.

In this inkjet head 10, the ink is supplied from the common ink chamber 14*a* into the respective pressure chambers 15 through the ink supply paths 12*a* and the through holes 13*a*. Further, when the driving signal including expansion pulses and contraction pulses is applied to the driving electrode of each actuator 16 from the driving circuits as will be described later, each actuator 16 deforms to vibrate the vibration plate 11*d*, and a capacity of each corresponding pressure chamber 15 expands and contracts. Consequently, a pressure applied to the ink in each pressure chamber 15 is changed, and the ink is discharged from each nozzle 11*e* toward the recording medium 50.

Figure 3:
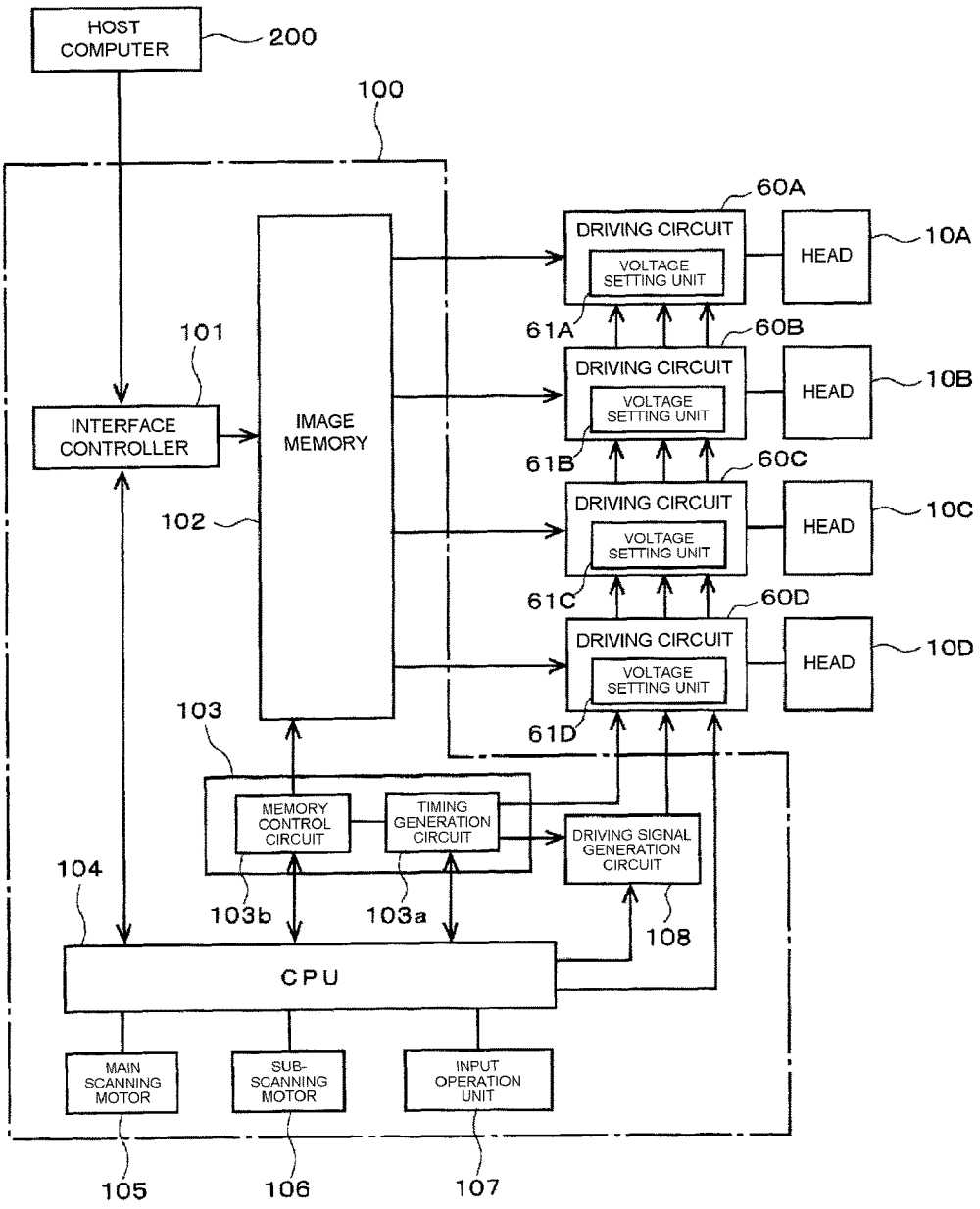
FIG. 3 is a block diagram showing an embodiment of an electrical configuration of the inkjet recording apparatus.

FIG. 3 is a block diagram showing an embodiment of an electrical configuration of the inkjet recording apparatus 1.

In FIG. 3, reference sign 100 denotes a control apparatus, reference sign 200 denotes a host computer, and reference signs 60A to 60D denote driving circuits corresponding to the inkjet heads 10A to 10D on one-on-one level.

As shown in FIG. 3, the control apparatus 100 includes an interface controller 101, an image memory 102, a transferrer 103, a CPU 104, a main scanning motor 105, a sub-scanning motor 106, an input operation unit 107, a driving signal generation circuit 108, and others.

The interface controller 101 fetches image information which is to be graphically printed on the recording medium 50 from the host computer 200 connected thereto through a communication line.

It is to be noted that, in case of performing later-described multi-gradation printing, this image information preferably includes gradation information of the ink which is to be discharged from each nozzle 11*e* of the inkjet heads 10A to 10D as well.

The image memory 102 temporarily stores image information which is acquired through the interface controller 101. The image information in the image memory 102 is sent to the driving circuits 60A to 60D.

The transferrer 103 transfers partial image information, which is recorded by single discharge from a plurality of nozzles of the respective inkjet heads 10A to 10D, from the image memory 102 to the respective driving circuits 60A to 60D. The transferrer 103 includes a timing generation circuit 103*a* and a memory control circuit 103*b*. The timing generation circuit 103*a* obtains positional information of the carriage 20 by, e.g., a non-illustrated encoder sensor. The memory control circuit 103*b* obtains an address of the partial image formation required for each of the inkjet heads 10A to 10D from this positional information. Moreover, the memory control circuit 103*b* uses the address of this partial image information to perform reading from the image memory 102 and transfer to the driving circuits 60A to 60D.

The CPU 104 is a control unit which integrates the inkjet recording apparatus 1, and controls carriage of the recording medium 50, movement of the carriage 20, discharge of the ink from each of the inkjet heads 10A to 10D, and others.

The main scanning motor 105 is a motor which moves the carriage 20 shown in FIG. 1 in the main scanning direction. The sub-scanning motor 106 is a motor which carries the recording medium 50 in the sub-scanning direction. Driving of these motors 105 and 106 is controlled by the CPU 104.

The input operation unit 107 is a portion through which the CPU 104 accepts various kinds of input operations performed by an operator, and it is constituted of, e.g., a touch panel.

It is to be noted that, as will be described later, in case of enabling changing a droplet amount in correspondence with a type of the recording medium 50 used in the inkjet recording apparatus 1, input keys provided in this input operation unit 107 preferably include a recording medium selection key to select a type of the recording medium 50. As types of the recording medium 50, there are plain paper, glossy paper, cloth, a plastic sheet, and the like.

The driving signal generation circuit 108 generates signal waveforms of the driving signals to discharge the ink from each of the inkjet heads 10A to 10D. The signal waveforms are synchronized with a latch signal of the image information of the timing generation circuit 103*a*, generated in accordance with each latch signal, and output to the driving circuits 60A to 60D.

The driving circuits 60A to 60D drive the respective actuators 16 of the corresponding inkjet heads 10A to 10D. The driving circuits 60A to 60D are mounted on the carriage 20 together with the inkjet heads 10A to 10D, and electrically connected with the control apparatus 100 through the flexible cables 30.

The driving circuits 60A to 60D have voltage setting units 61A to 61D, respectively. Each of the voltage setting units 61A to 61D sets a predetermined voltage to the signal waveforms of the driving signal supplied from the driving signal generation circuit 108. The driving circuits 60A to 60D apply the driving signal subjected to the voltage setting by each of the voltage setting units 61A to 61D to the driving electrode of the actuator 16 of each of the corresponding inkjet heads 10A to 10D based on the image information supplied from the image memory 102. A voltage value set by each of the voltage setting units 61A to 61D can be independently controlled by the CPU 104 in accordance with each of the driving circuits 60A to 60D.

The driving signal will now be described.

Figure 4:
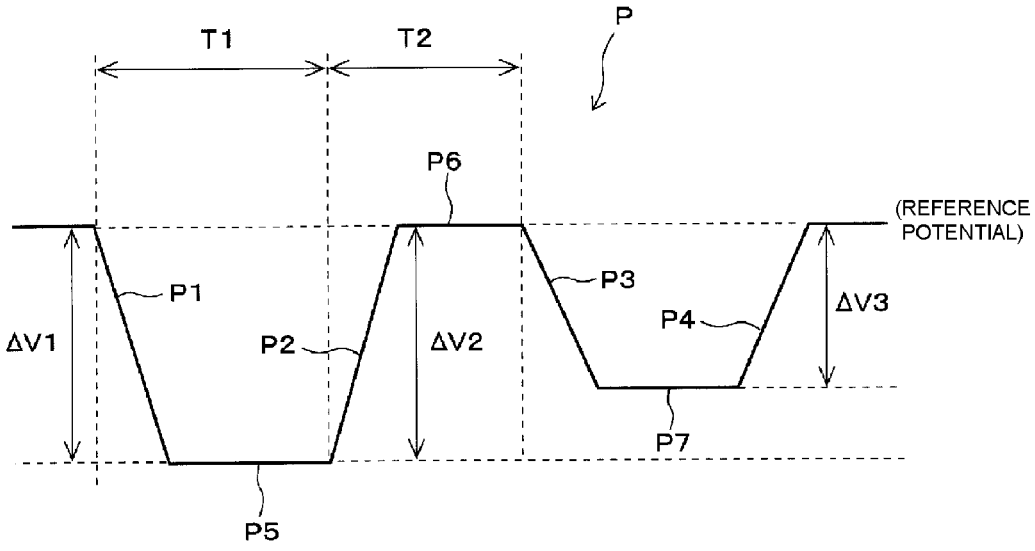
FIG. 4 is a view showing an embodiment of a driving signal.

FIG. 4 shows an embodiment of the driving signal output from each of the driving circuits 60A to 60D to each of the inkjet heads 10A to 10D.

As shown in FIG. 4, this driving signal P includes a first expansion pulse P1 which starts from a reference potential and expands the capacity of the pressure chamber 15, a first contraction pulse P2 which contracts the capacity of the pressure chamber 15 to discharge the ink from the nozzle, a second expansion pulse P3 which expands the capacity of the pressure chamber 15, and a second contraction pulse P4 which contracts the capacity of the pressure chamber 15 and returns to the reference potential in the mentioned order.

A maintenance pulse P5 to maintain a potential of the first expansion pulse P1 is provided between an end edge of the first expansion pulse P1 and a start edge of the first contraction pulse P2. Additionally, an intermediate pulse P6 to hold a fixed potential is provided between an end edge of the first contraction pulse P2 and a start edge of the second expansion pulse P3. Further, a maintenance pulse P7 to maintain a potential of the second expansion pulse P3 is provided between an end edge of the second expansion pulse P3 and a start edge of the second contraction pulse P4.

It is to be noted that the maintenance pulses P5 and P7 are flat pulses in this embodiment, but they may be slightly inclined upward so as not to obstruct the ink discharge without being restricted to the flat pulses.

Furthermore, reference sign ΔV1 denotes a potential difference between the reference potential and the end edge of the first expansion pulse P1. Reference sign ΔV2 denotes a potential difference between the start edge and the end edge of the first contraction pulse P2. Reference sign ΔV3 designates a potential difference between the start edge of the second contraction pulse P4 and the reference potential.

A driving signal P shown in this embodiment is constituted of a slope waveform in which rise and fall of each of the pulses P1, P2, P3, and P4 are inclined. When the slope waveform is adopted, an effect of suppressing unstable discharge, e.g., a satellite, a speed abnormality, or bending can be provided, which is a preferred mode in the present invention.

When this driving signal P is applied to the driving electrode of the actuator 16 of each of the inkjet heads 10A to 10D, the capacity of each pressure chamber 15 first starts to expand by the first expansion pulse P1 from an initial state where both expansion and contraction are yet to begin. Consequently, the ink flows into each pressure chamber 15 from the common ink chamber 14*a*. This expanded state is maintained for a period of the maintenance pulse P5.

Then, the capacity of the pressure chamber 15 which is in the expanded state starts to contract by the first contraction pulse P2. The contraction of the capacity of the pressure chamber 15 causes a positive pressure wave in the pressure chamber 15. Consequently, the ink is extruded from each nozzle 11*e*, and the ink is discharged. This contracted state is maintained for a period of the intermediate pulse P6.

Then, the capacity of the pressure chamber 15 again starts to expand by the second expansion pulse P3. After the intermediate pulse P6, a pulse started by this second expansion pulse P3 is a cancel pulse which cancels a reverberation pressure wave in the pressure chamber 15 produced by the first contraction pulse P2. When the capacity of the pressure chamber 15 expands, a negative pressure wave is produced in the pressure chamber 15. Consequently, the positive pressure wave produced in the pressure chamber 15 by the first contraction pulse P2 is canceled.

At the same time, a tail part of the ink extruded from each nozzle 11*e* by the first contraction pulse P2 is pulled toward the nozzle 11*e* size. Consequently, the ink discharged from each nozzle 11*e* by the first contraction pulse P2 is forcibly separated from the ink in the nozzle 11*e*. When the tail part of the ink is pulled, the tail part is shortened, and hence a satellite associated with the discharged ink is suppressed. The separated ink impacts the recording medium 50 to form a dot. The expanded state provided by the second expansion pulse P3 is maintained for a period of the maintenance pulse P7.

Then, the capacity of each pressure chamber 15 is again contracted by the second contraction pulse P4. Then, when the second contraction pulse P4 returns to the reference potential, the capacity of each pressure chamber 15 is restored to the initial state where both the expansion and the contraction are not performed.

Here, the driving circuits 60A to 60D are configured to enable changing the potential difference ΔV2 in the driving signal P by using the respective voltage setting units 61A to 61D.

Figure 5:
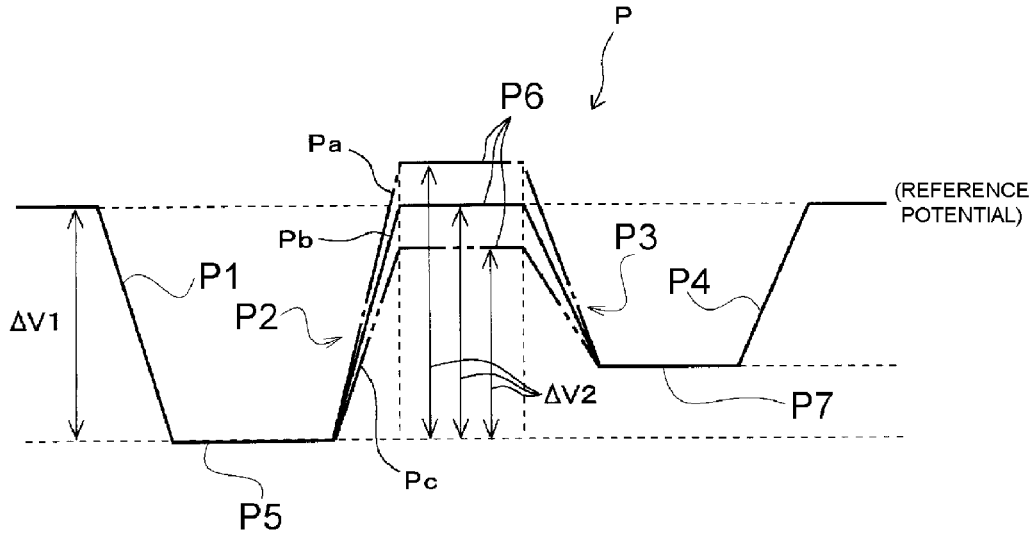
FIG. 5 is an explanatory drawing of a driving signal having an adjusted potential difference ratio ΔV2/ΔV1.

FIG. 5 shows how the potential difference ΔV2 of the driving signal P is changed. FIG. 5 shows a state where the potential difference ΔV2 is increased or decreased while maintaining the potential difference ΔV1 of the driving signal P constant in order to increase or decrease a droplet amount. Furthermore, in this embodiment, in the light of suppression of the satellite or stable discharge, each of a potential at the start edge of the first contraction pulse P2 and a potential at the end edge of the second expansion pulse P3 is maintained at a fixed potential without changing, which is a preferred mode in the present invention.

The driving circuits 60A to 60D change the potential difference ΔV2 of the driving signal P by using the voltage setting units 61A to 61D, thereby enabling changing between a driving signal Pa having the increased potential difference ΔV2 as indicated by an alternate long and short dash line in FIG. 5 and a driving signal Pc having the reduced potential difference ΔV2 as indicated by an alternate long and two short dashes line in FIG. 5. At this time, the maintenance period of the intermediate pulse P6 is not changed, but inclinations of the first contraction pulse P2 and the second expansion pulse P3 are changed. Consequently, even if the potential difference ΔV2 is changed, the period from the start edge of the first expansion pulse P1 to the end edge of the second contraction pulse P4 is constant, and a maximum driving frequency is not changed, which is preferable in the present invention. However, in case of attaching importance to suppression of the unstable discharge, e.g., the satellite, the maintenance period of the intermediate pulse P6 may be changed so that the inclinations of the first contraction pulse P2 and the second expansion pulse P3 become constant.

As described above, when the potential difference ΔV2 of the driving signal P is changed, the potential of the intermediate pulse P6 is relatively changed. Consequently, an extrusion amount of the ink extruded from each nozzle 11*e* when the capacity of each pressure chamber 15 contracts by the first contraction pulse P2 varies.

Figure 6A:
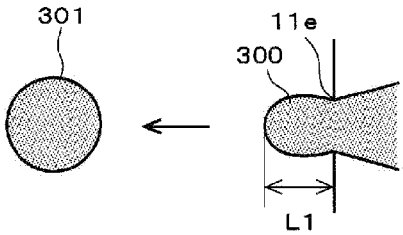
FIG. 6A is an explanatory drawing of a state where a large droplet is discharged by a driving signal whose potential difference ratio ΔV2/ΔV1 has been greatly changed.
Figure 6B:
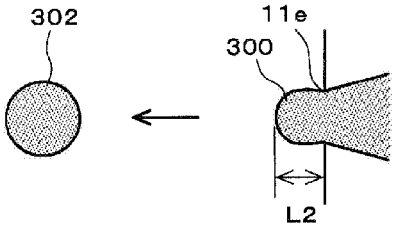
FIG. 6B is an explanatory drawing of a state where a medium droplet is discharged by a driving signal whose potential difference ratio ΔV2/ΔV1 is not changed.
Figure 6C:
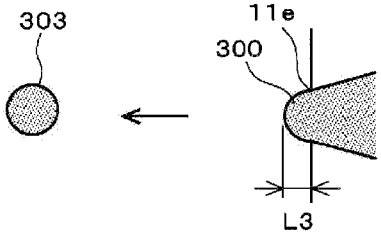
FIG. 6C is an explanatory drawing of a state where a small droplet is discharged by a driving signal whose potential difference ratio ΔV2/ΔV1 has been slightly changed.

FIG. 6A is an explanatory drawing of a state where a large droplet is discharged by the driving signal whose potential difference ratio ΔV2/ΔV1 has been greatly changed, FIG. 6B is an explanatory drawing of a state where a medium droplet is discharged by the driving signal whose potential difference ratio ΔV2/ΔV1 is not changed, and FIG. 6C is an explanatory drawing of a state where a small droplet is discharged by the driving signal whose potential difference ratio ΔV2/ΔV1 has been slightly changed.

For example, when the driving signal Pa is applied to the driving electrode of each actuator 16, the potential of the intermediate pulse P6 becomes relatively larger than that when the driving signal Pb, which is the reference potential, is applied, and hence a contraction amount of the capacity of each pressure chamber 15 provided by the first contraction pulse P2 also becomes large. Consequently, as shown in FIG. 6A, an extrusion amount L1 of an ink 300 extruded from each nozzle 11*e* becomes larger than an extrusion amount L2 of the ink 300 when the driving signal Pb is applied as shown in FIG. 6B. Moreover, the cancel pulse forcibly separates the ink 300 in a state where the extrusion amount is large. Thus, a droplet 301 whose droplet amount is larger than that of a droplet 302 shown in FIG. 6B discharged by the driving signal Pb is discharged from the nozzle 11*e*.

On the other hand, when the driving signal Pc is applied to the driving electrode of each actuator 16, the potential of the intermediate pulse P6 is relatively lowered, and hence the contraction amount of the capacity of each pressure chamber 15 provided by the first contraction pulse P2 is also decreased. Consequently, as shown in FIG. 6C, an extrusion amount L3 of the ink 300 extruded from each nozzle 11*e* becomes smaller than the extrusion amount L2 of the ink 300 when the driving signal Pb shown in FIG. 6B is applied. Additionally, the cancel pulse forcibly separates the ink 300 in a state where the extrusion amount is small. Thus, a droplet 303 having a smaller droplet amount than that of the droplet 302 is discharged from each nozzle 11*e*.

That is, the extrusion amounts of the ink 300 have a relationship of L1>L2>L3, and the droplet amounts of the discharged ink thereby have a relationship of the droplet 301>the droplet 302>the droplet 303. Thus, changing the potential difference ΔV2 of the driving signal P enables increasing or decreasing the droplet amount of the ink discharged from the nozzle 11*e*.

Further, even if the droplet amount is increased or decreased in this manner, a droplet speed of the ink does not substantially vary. The reason for this is as follows. Since the potential difference ΔV1 of the potential signal P is fixed, a degree of expansion of the capacity of each pressure chamber 15 provided by the first expansion pulse P1 is fixed irrespective of the droplet amount. Furthermore, the second expansion pulse P3 has a role to forcibly separate the ink discharged by the application of the first compression pulse P2 and cut the tail of the ink to be discharged. When the potential difference ΔV2 is large, discharge energy provided by the application of the first compression pulse P2 becomes large, and energy provided by the application of the second expansion pulse P3 also becomes large. On the other hand, when the potential difference ΔV2 is small, the discharge energy provided by the application of the first compression pulse P2 becomes small, and the energy provided by the application of the second expansion pulse P3 also becomes small. As a result, an extrusion speed of the ink extruded from each nozzle 11*e* does not vary, and a droplet speed of the ink does not substantially change.

The present inventor has confirmed that, when voltage adjustment was performed so that the potential difference ΔV2 could increase while maintaining the potential difference ΔV1 constant with respect to a standard droplet amount 3.0 μl of the ink discharged when the intermediate pulse P6 of the driving signal P was set to the reference potential, the droplet speed did not substantially change and a large droplet of 4.6 μl (an increase of approximately 50%) was successfully discharged at a maximum. On the other hand, likewise, when the voltage adjustment was performed so that the potential difference ΔV2 could decrease while maintaining the potential difference ΔV1 constant, the droplet speed did not substantially change, and a small droplet of 1.9 μl (a decrease of approximately 40%) was successfully discharged at a minimum. That is, it was possible to control a droplet amount from 1.9 μl to 4.6 μl which is approximately 2.5 times without changing the droplet speed.

Thus, greatly or slightly changing the potential difference ΔV2 of the driving signal P output from each of the driving circuits 60A to 60D to each of the inkjet heads 10A to 10D enables changing the droplet amount without changing the droplet speed of the ink discharged from the same nozzle 11*e*. Since the driving signal for each droplet amount is used for just changing the potential difference ΔV2 of the same driving signal P, a different driving signal for each droplet amount does not have to be prepared, and the control does not become complicated. Moreover, even if the droplet amount is changed, since the droplet speed does not substantially vary, an impact positional displacement does not occur in accordance with each droplet amount, and the discharge timing does not have to be adjusted every time the droplet amount changes.

It is preferable for each of the driving circuits 60A to 60D to enable changing the potential difference ΔV2 so that the potential difference ratio ΔV2/ΔV1 of the driving signal P falls in the range of 0.8 to 1.2. The ink to be discharged begins to scatter when this ratio falls below 0.8, or the ink to be discharged begins to slur when the same exceeds 1.2, and the ink is hardly stabilized in both cases. Thus, when the potential difference ΔV2 is changed so that the potential difference ratio ΔV2/ΔV1 falls within the range of 0.8 to 1.2, different droplet amounts of the ink can be stably discharged in a state where the droplet speed does not vary.

In the driving signal P, when the potential differences ΔV2 and ΔV3 are compared, ΔV2>ΔV3 is realized. Consequently, the ink is not further discharged from each nozzle 11*e* due to the second contraction pulse P4 constituting the cancel pulse.

It is preferable for the potential difference ratio ΔV3/ΔV2 of the potential differences ΔV2 and ΔV3 to be 0.3 or more and 0.9 or less. In this range, the reverberation pressure wave produced in each pressure chamber 15 after applying the first contraction pulse P2 can be effectively suppressed, and the ink can be stably discharged. The suppression of the reverberation pressure wave is important for performing high-frequency driving. When this ratio is smaller than 0.3, it is not appropriate for the cancel pulse. It is preferable for the potential difference ratio ΔV3/ΔV2 to be 0.5 or more and 0.9 or less, and 0.8 is most preferable.

It is preferable for a period T1 from the start edge of the first expansion pulse P1 to the start edge of the first contraction pulse P2 of the driving signal P to be 0.45 Tc or more and 0.55 Tc or less. Consequently, the ink can be most effectively discharged.

Here, Tc represents a vibration cycle of the ink in each pressure chamber 15. This Tc can be expressed by, e.g., the following formula.

$$Tc=2\pi[(Mn\times Ms)/(Mn+Ms)\times Cc]^{1/2}$$

Mn is inertance in each nozzle 11*e*, Ms is inertance in a supply port of the ink to each pressure chamber 15, and Cc is compliance of each pressure chamber 15. The inertance represents ease of movement of the ink in an ink flow path, and it is a mass of the ink per unit cross-sectional area. The inertance M can be expressed by approximation using the following formula.

$$M=(\rho\times L)/S$$

ρ is density of the ink, S is a cross-sectional area of a surface orthogonal to an ink flow direction of the ink flow path, and L is a length of the ink flow path.

In the driving signal P, assuming that a period from the start edge of the first expansion pulse P1 to the start edge of the first contraction pulse P2 is T1 and a period from the start edge of the first contraction pulse P2 to the start edge of the second expansion pulse P3 is T2, it is preferable for T2/T1 to be 0.6 or more and 1.2 or less. When T2/T1 falls within this range, a satellite associated with the ink discharged from each nozzle 11*e* is suppressed, and the ink can be stably discharged. It is preferable for T2/T1 to be 0.6 or more and 1.0 or less since the discharge can be performed without reducing discharge efficiency, and further preferable for the same to be 0.7 or more and 0.9 or less since the discharge can be stably performed with the good discharge efficiency.

A description will now be given as to a specific mode to change the potential difference ΔV2 of the driving signal P by using each of the driving circuits 60A to 60D and thereby change the droplet amount from the same nozzle 11*e* without changing the droplet speed.

When different droplet amounts of the ink discharged from the same nozzle 11*e* impact the recording medium 50, they form dots having different diameters, respectively. Thus, discharging the different droplet amounts of the ink from the same nozzle 11*e* enables performing multi-gradation printing on the recording medium 50.

The droplet amounts of the ink discharged from the same nozzle 11*e* are determined based on gradation information included on image data to be graphically printed. At this time, it is preferable to prepare a table in which a relationship between a gradation (a droplet amount) and a value of the potential difference ΔV2 of the driving signal P is prescribed in advance in the CPU 104, the driving circuits 60A to 60D, or the like. Making reference to this table enables rapidly setting a voltage of the driving signal P from the gradation information of the image data.

In case of performing the multi-gradation printing, the ink discharged from the same nozzle 11*e* per pixel is not restricted to one droplet, and it may be a plurality of droplets. That is, when the plurality of driving signals are continuously applied within one pixel cycle and the plurality of droplets of the ink are discharged from the same nozzle 11*e*, a large droplet having a larger droplet amount can be formed. The plurality of droplets of the ink are combined with each other during flight or overlap each other on the recording medium 50 to form a large dot. In this case, when the driving signal P is used as a driving signal which forms at least a last droplet, a large dot having suppressed satellites can be formed.

Further, it is also preferable to adjust a diameter of a dot formed on the recording medium 50 by enabling changing a droplet amount of the ink discharged from the same nozzle 11*e*, i.e., enabling changing the potential difference ΔV2 of the driving signal P in accordance with a type of the recording medium 50.

For example, even if the same droplet amount of the ink is discharged, a diameter of a dot formed on the recording medium 50 differs depending on the adopted recording medium 50 with high ink absorbency like cloth or a counterpart with low ink absorbency like a plastic sheet. When the ink absorbency becomes higher, the dot is apt to spread to the periphery while being absorbed by the recording medium 50, and a dot diameter tends to increase as compared with that when the ink absorbency is lower. Thus, even if printing is performed based on the same image data, there is fear that an impression of an image to be formed greatly differs depending on a type of the recording medium 50.

Thus, a droplet amount of the ink discharged from the same nozzle 11*e* is changed depending on a type of the recording medium 50, and a diameter of a dot formed on the recording medium 50 is appropriately adjusted, thereby homogenizing an image.

Specifically, as the ink absorbency of the recording medium 50 increases, the potential difference ΔV2 of the driving signal P is reduced so that a droplet amount of the ink to be discharged can be decreased. Since a droplet speed does not vary, an impact positional displacement does not occur in accordance with each type of the recording medium 50, and discharge timing does not have to be again adjusted in accordance with each type of the recording medium 50.

The type of the recording medium 50 is generally set by operating the input operation unit 107 for input by an operator. Furthermore, although not shown, the type of the recording medium 50 to be used may be automatically detected by, e.g., detecting a type of a dedicated tray prepared for each type of the recording medium 50 with the use of a sensor provided in the inkjet recording apparatus 1.

At the time of determining a droplet amount of the ink corresponding to each type of the recording medium 50, it is preferable to prepare a table in which a relationship between the droplet amount and the potential difference ΔV2 of the driving signal P is prescribed in advance in accordance with each type of the recording medium 50 in the CPU 104, the driving circuits 60A to 60D, or the like. Making reference to this table enables rapidly setting the optimum potential difference ΔV2 of the driving signal P in accordance with each type of the recording medium 50.

It is to be noted that, in case of performing the multi-gradation printing, the droplet amount of the ink can be changed in accordance with each type of the recording medium 50 as a matter of course. That is, as the ink absorbency of the recording medium 50 increases, the droplet amount of the ink to be discharged is changed to become small by reducing the potential difference ΔV2 of the driving signal P at the time of performing the multi-gradation printing. Consequently, an image formed in the multi-gradation printing can be homogenized irrespective of types of the recording medium 50.

As described above, according to the present invention, it is possible to provide the inkjet recording apparatus and the inkjet recording method which enable changing the droplet amount without changing the droplet speed of the ink discharged from the same nozzle.

EXAMPLE

An effect of the present invention will now be illustrated hereinafter.

As shown in FIG. 5, a droplet volume and a droplet speed of the ink discharged from the same nozzle were measured by changing the potential difference ΔV2 of the driving signal P shown in FIG. 4 with the use of the inkjet head having the structure shown in FIG. 2. Here, the potential difference ratio ΔV2/ΔV1 was changed while maintaining the potential difference ΔV1 constant.

(Inkjet Head)

Vibration cycle of each pressure chamber: Tc=6 μs

Ink viscosity: 10 cp (Driving Waveform)

T1: 3 μs

T2: 2.5 μs

P5: 2.0 μs

P6: 1.0 μs

P7: 0.5 μs

Driving cycle (the start edge of P1 to the end edge of P4): 8.5

Reference potential: 0 V

ΔV1: 20 V

ΔV3: 16 V

Figure 7:
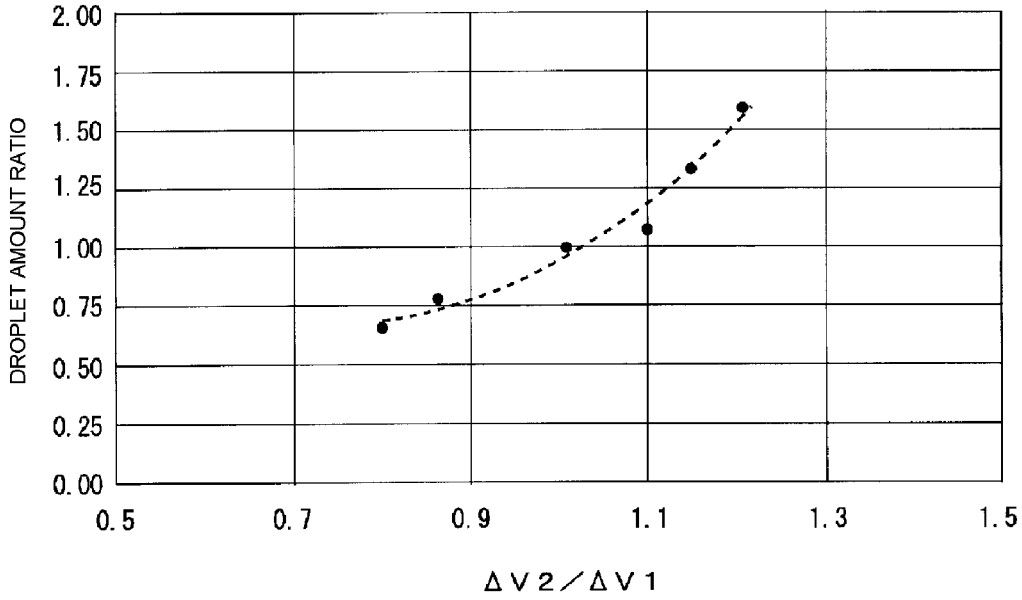
FIG. 7 is a graph showing a relationship between the potential difference ratio ΔV2/ΔV1 and a droplet amount ratio.

The droplet volume was calculated by recognizing an image of each flying droplet with the use of a droplet observation apparatus and converting it into a volume (pl) when considering the droplet as one sphere. Furthermore, a droplet amount ratio when the potential difference ratio ΔV2/ΔV1 was changed was calculated from a ratio to the droplet volume when ΔV2/ΔV1=1. Table 1 and a graph of FIG. 7 show this result.

Figure 8:
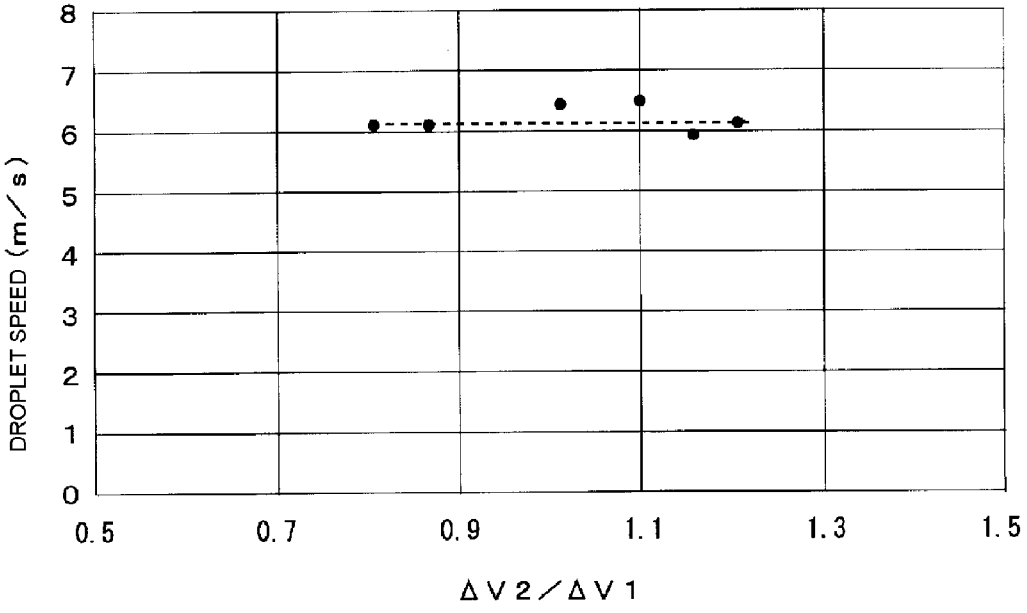
FIG. 8 is a graph showing a relationship between the potential difference ratio ΔV2/ΔV1 and a droplet speed.

The droplet speed was calculated by recognizing an image of each droplet with the use of the droplet observation apparatus, and a distance that the droplet flies from a position which is 500 μm away from a nozzle surface during 50 μs was calculated by image processing. Table 1 and FIG. 8 show this result.

TABLE 1

| ΔV2/ΔV1 | Droplet volume (pl) | Droplet amount ratio | Droplet speed (m/s) |
|---|---|---|---|
| 0.8 | 1.90 | 0.64 | 6.1 |
| 0.85 | 2.33 | 0.78 | 6.15 |
| 1 | 2.98 | 1.00 | 6.52 |
| 1.1 | 3.22 | 1.08 | 6.65 |
| 1.15 | 4.03 | 1.35 | 5.8 |
| 1.2 | 4.75 | 1.59 | 6.27 |

As described above, it can be understood that the droplet amount can be increased or decreased by changing the potential difference ΔV2 of the driving signal P. The droplet speed does not greatly vary due to a change in this potential difference ΔV2, and it is substantially constant.

Next, as regards the same inkjet head as that described above, a discharge state of the ink when the potential difference ratio ΔV3/ΔV2 was changed as shown in Table 2 in a case where the potential difference ratio ΔV2/ΔV1=1 of the driving signal P shown in FIG. 4 was achieved was evaluated. Table 2 shows this result.

TABLE 2

| ΔV3/ΔV2 | Evaluation |
|---|---|
| 0.1 | X: Reverberation pressure wave in pressure chamber is not suppressed |
| 0.3 | Δ: Suppression of reverberation pressure wave in pressure chamber is insufficient |
| 0.5 | ○: Stable discharge was performed |
| 0.7 | ○: Stable discharged was performed |
| 0.8 | ◎: Stable discharged was performed, and discharge was performed at higher frequency |
| 0.9 | ○: Stable discharge was performed |
| 1 | X: Two droplets were discharged |

Then, as regards the same inkjet head as that described above, a discharge state of the ink when T1/T2 of the driving signal P shown in FIG. 4 was changed as shown in Table 3 was evaluated. Table 3 shows this result.

TABLE 3

| T1/T2 | Period of intermediate pulse (μs) | Discharge state |
|---|---|---|
| 0.55 | 0.3 | X: Satellite was generated |
| 0.61 | 0.5 | ○: Stable discharge was performed |
| 0.76 | 1 | ◎: Stable discharge was performed with good discharge efficiency |
| 0.82 | 1.2 | ◎: Stable discharge was performed with good discharge efficiency |
| 0.91 | 1.5 | ○: Stable discharge was performed |
| 1.06 | 2 | Δ: Discharge efficiency was lowered |
| 1.21 | 2.5 | X: Discharge efficiency was very poor |

REFERENCE SIGNS LIST

1: inkjet recording apparatus
10, 10A to 10D: inkjet head
11: head substrate
11*a*: nozzle plate
11*b*: intermediate plate
11*c*: pressure chamber plate
11*d*: vibration plate
11*e*: nozzle
12: wiring substrate
12*a*: ink supply path
13: adhesive resin layer
13*a*: through hole
14: ink manifold
14*a*: common ink chamber
15: pressure chamber
16: actuator
20: carriage
30: flexible cable
40: guide rail
50: recording medium
60A to 60D: driving circuit
601: voltage setting unit
100: control apparatus
101: interface controller
102: image memory
103: transferrer
103*a*: timing generation circuit
103*b*: memory control circuit
104: CPU
105: main scanning motor
106: sub-scanning motor
107: input operation unit
108: driving signal generation circuit
200: host computer
P, Pa, Pb: driving signal
P1: first expansion pulse
P2: first contraction pulse
P3: second expansion pulse
P4: second contraction pulse
P5: maintenance pulse
P6: intermediate pulse
P7: maintenance pulse

The invention claimed is:

1. An inkjet recording apparatus comprising:

an inkjet head which expands and contracts a capacity of a pressure chamber corresponding to an actuator by applying a driving signal to the actuator, and thus discharges an ink in the pressure chamber from a nozzle as a discharged droplet to perform printing on a recording medium; and a driving circuit which applies the driving signal to the actuator of the inkjet head, wherein the driving signal includes a first expansion pulse which starts from a reference potential and expands the capacity of the pressure chamber, a first contraction pulse which contracts the capacity of the pressure chamber to discharge the ink from the nozzle, a second expansion pulse which expands the capacity of the pressure chamber, and a contraction pulse which contracts the capacity of the pressure chamber and returns to the reference potential in the mentioned order, and the driving circuit is configured to vary a volume of the discharged droplet from the same nozzle by changing a potential difference between a start edge and an end edge of the first contraction pulse.

2. The inkjet recording apparatus according to claim 1, wherein the driving circuit discharges the different droplet amounts of the ink from the same nozzle by changing the potential difference, and thus performs multi-gradation printing on the recording medium.

3. The inkjet recording apparatus according to claim 1, wherein the driving circuit is configured to enable changing the potential difference in correspondence with a type of the recording medium.

4. The inkjet recording apparatus according to claim 1, wherein the driving circuit is configured to enable changing a potential difference ΔV2 so that a potential difference ratio ΔV2/ΔV1 falls within a range of 0.8 to 1.2, where ΔV1 is a potential difference between the reference potential and an end edge of the first expansion pulse and ΔV2 is a potential difference between a start edge and an end edge of the first contraction pulse.

5. The inkjet recording apparatus according to claim 1, wherein a period T1 from the start edge of the first expansion pulse to the start edge of the first contraction pulse is 0.45 Tc or more and 0.55 Tc or less, where Tc is a vibration cycle of the ink in the pressure chamber.

6. The inkjet recording apparatus according to claim 1, wherein ΔV2>ΔV3 is achieved, where ΔV2 is the potential difference between the start edge and the end edge of the first contraction pulse and ΔV3 is a potential difference between the start edge of the second contraction pulse and the reference potential.

7. The inkjet recording apparatus according to claim 6, wherein a potential difference ratio ΔV3/ΔV2 is 0.3 or more and 0.9 or less.

8. The inkjet recording apparatus according to claim 6, wherein a potential difference ratio ΔV3/ΔV2 is 0.5 or more and 0.9 or less.

9. The inkjet recording apparatus according to claim 1, wherein T2/T1 is 0.6 or more and 1.2 or less, where T1 is a period from the start edge of the first expansion pulse to the start edge of the first contraction pulse and T2 is a period from the start edge of the first contraction pulse and the start edge of the second expansion pulse.

10. The inkjet recording apparatus according to claim 1, wherein T2/T1 is 0.6 or more and 1.0 or less, where T1 is a period from the start edge of the first expansion pulse to the start edge of the first contraction pulse and T2 is a period from the start edge of the first contraction pulse to the start edge of the second expansion pulse.

11. The inkjet recording apparatus according to claim 1, wherein the driving signal has a slope waveform.

12. The inkjet recording apparatus according to claim 1, wherein the drive circuit is configured to maintain a constant time length between the start edge and the end edge of the first contraction pulse when changing a potential difference between the start edge and the end edge of the first contraction pulse.

13. An inkjet recording method comprising expanding and contracting a capacity of a pressure chamber corresponding to an actuator by applying a driving signal to the actuator of an inkjet head, and thus discharging an ink in the pressure chamber from a nozzle as a discharged droplet to perform printing on a recording medium, wherein the driving signal includes a first expansion pulse which starts from a reference potential and expands the capacity of the pressure chamber, a first contraction pulse which contracts the capacity of the pressure chamber to discharge the ink from the nozzle, a second expansion pulse which expands the capacity of the pressure chamber, and a contraction pulse which contracts the capacity of the pressure chamber and returns to the reference potential in the mentioned order, and a volume of the discharged droplet from the same nozzle is varied by changing a potential difference between a start edge and an end edge of the first contraction pulse.

14. The inkjet recording method according to claim 13, wherein the different droplet amounts of the ink are discharged from the same nozzle by changing the potential difference, and thus multi-gradation printing is performed on the recording medium.

15. The inkjet recording method according to claim 13, wherein the potential difference is changed in correspondence with a type of the recording medium.

16. The inkjet recording method according to claim 13, wherein a potential difference ΔV2 is changed so that a potential difference ratio ΔV2/ΔV1 falls within a range of 0.8 to 1.2, where ΔV1 is a potential difference between the reference potential and an end edge of the first expansion pulse and ΔV2 is a potential difference between a start edge and an end edge of the first contraction pulse.

17. The inkjet recording method according to claim 13, wherein a period T1 from the start edge of the first expansion pulse to the start edge of the first contraction pulse is 0.45 Tc or more and 0.55 Tc or less, where Tc is a vibration cycle of the ink in the pressure chamber.

18. The inkjet recording method according to claim 13, wherein ΔV2>ΔV3 is achieved, where ΔV2 is the potential difference between the start edge of the first contraction pulse and the end edge of the first contraction pulse and ΔV3 is a potential difference between the start edge of the second contraction pulse and the reference potential.

19. The inkjet recording method according to claim 18, wherein a potential difference ratio ΔV3/ΔV2 is 0.3 or more and 0.9 or less.

20. The inkjet recording method according to claim 18, wherein a potential difference ratio ΔV3/ΔV2 is 0.5 or more and 0.9 or less.

21. The inkjet recording method according to claim 13, wherein T2/T1 is 0.6 or more and 1.2 or less, where T1 is a period from the start edge of the first expansion pulse to the start edge of the first contraction pulse and T2 is a period from the start edge of the first contraction pulse and the start edge of the second expansion pulse.

22. The inkjet recording method according to claim 13, wherein T2/T1 is 0.6 or more and 1.0 or less, where T1 is a period from the start edge of the first expansion pulse to the start edge of the first contraction pulse and T2 is a period from the start edge of the first contraction pulse to the start edge of the second expansion pulse.

23. The inkjet recording method according to claim 13, wherein the driving signal has a slope waveform.

24. The inkjet recording method according to claim 13, a constant time length is maintained between the start edge and the end edge of the first contraction pulse when changing a potential difference between the start edge and the end edge of the first contraction pulse.

* * * * *